US011446784B2

(12) United States Patent
Ishii et al.

(10) Patent No.: US 11,446,784 B2
(45) Date of Patent: Sep. 20, 2022

(54) CHEMICAL MECHANICAL POLISHING APPARATUS FOR POLISHING WORKPIECE

(71) Applicants: EBARA CORPORATION, Tokyo (JP); FUJIMI INCORPORATED, Kiyosu (JP)

(72) Inventors: Yu Ishii, Tokyo (JP); Kenya Ito, Tokyo (JP); Hitoshi Morinaga, Kiyosu (JP); Kazusei Tamai, Kiyosu (JP); Shingo Ohtsuki, Kiyosu (JP); Hiroshi Asano, Kiyosu (JP)

(73) Assignees: EBARA CORPORATION, Tokyo (JP); FUJIMI INCORPORATED, Kiyosu (JP)

( * ) Notice: Subject to any disclaimer, the term of this patent is extended or adjusted under 35 U.S.C. 154(b) by 724 days.

(21) Appl. No.: 16/412,562

(22) Filed: May 15, 2019

(65) Prior Publication Data

US 2019/0262968 A1 Aug. 29, 2019

Related U.S. Application Data

(63) Continuation of application No. 15/520,515, filed as application No. PCT/JP2015/080823 on Oct. 30, 2015, now abandoned.

(30) Foreign Application Priority Data

Oct. 31, 2014 (JP) ..... JP2014-223292

(51) Int. Cl.
*B24B 9/06* (2006.01)
*B24B 5/04* (2006.01)
(Continued)

(52) U.S. Cl.
CPC ..... *B24B 37/042* (2013.01); *B24B 5/04* (2013.01); *B24B 5/047* (2013.01); *B24B 5/363* (2013.01);
(Continued)

(58) Field of Classification Search
CPC ... B24B 37/005; B24B 37/013; B24B 37/042; B24B 37/02; B24B 37/10; B24B 37/24;
(Continued)

(56) References Cited

U.S. PATENT DOCUMENTS 4,266,373 A * 5/1981 Bornefeld ..... B24B 9/00 451/236
4,299,061 A * 11/1981 Parnum ..... B23Q 35/103 409/122
(Continued)

FOREIGN PATENT DOCUMENTS

CN 103419123 A 12/2013
JP H07-9322 A 1/1995
(Continued)

OTHER PUBLICATIONS

International Search Report issued in Patent Application No. PCT/JP2015/080823 dated Dec. 15, 2015.
(Continued)

*Primary Examiner* — Eileen P Morgan
(74) *Attorney, Agent, or Firm* — Pearne & Gordon LLP

(57) ABSTRACT

The present invention relates to a chemical mechanical polishing (CMP) apparatus for polishing a workpiece, such as a metal body, to a mirror finish. The chemical mechanical polishing apparatus includes: a polishing pad (2) having an annular polishing surface (2*a*) which has a curved vertical cross-section; a workpiece holder (11) for holding a workpiece (W) having a polygonal shape; a rotating device (15) configured to rotate the workpiece holder (11) about an axis of the workpiece (W); a pressing device (14) configured to press a periphery of the workpiece (W) against the annular polishing surface (2*a*); and an operation controller (25) configured to change a speed at which the rotating device (15) rotates the workpiece (W) according to a rotation angle of the workpiece (W). The pressing device (14) is disposed
(Continued)

more inwardly than the workpiece holder (11) in a radial direction of the polishing table (3).

8 Claims, 10 Drawing Sheets

(51) Int. Cl.

| | |
|---|---|
| ***B24B 19/08*** | (2006.01) |
| ***B24B 37/005*** | (2012.01) |
| ***B24B 37/04*** | (2012.01) |
| ***B24B 49/00*** | (2012.01) |
| ***B24B 9/10*** | (2006.01) |
| ***B24B 5/36*** | (2006.01) |
| ***B24B 37/10*** | (2012.01) |
| ***B24B 37/24*** | (2012.01) |
| ***B24B 37/30*** | (2012.01) |

(52) U.S. Cl.
CPC ..... *B24B 9/06* (2013.01); *B24B 9/107* (2013.01); *B24B 19/08* (2013.01); *B24B 37/005* (2013.01); *B24B 37/10* (2013.01); *B24B 37/24* (2013.01); *B24B 37/30* (2013.01); *B24B 49/006* (2013.01)

(58) Field of Classification Search
CPC ..... B24B 37/30; B24B 5/04; B24B 5/042; B24B 5/047; B24B 5/36; B24B 5/363; B24B 9/06; B24B 9/065; B24B 9/08; B24B 9/10; B24B 9/107; B24B 19/08; B24B 49/006; B24B 49/12; B24B 49/16
USPC ..... 451/44, 246, 254, 256, 5, 9, 10, 11
See application file for complete search history.

(56) References Cited

U.S. PATENT DOCUMENTS 5,403,228 A * 4/1995 Pasch ..... B24B 37/22 451/259
5,409,417 A * 4/1995 Bando ..... B24B 9/107 451/5
5,658,189 A * 8/1997 Kagamida ..... B24B 41/02 451/194
5,733,353 A * 3/1998 Bando ..... C03B 33/04 65/56
6,159,081 A * 12/2000 Hakomori ..... B24B 27/0023 451/65
6,250,995 B1 * 6/2001 Hakomori ..... B24B 9/065 451/194
6,722,964 B2 * 4/2004 Kimura ..... B24B 9/065 451/446
6,857,947 B2 * 2/2005 Wang ..... B24B 49/16 451/6
7,066,787 B2 * 6/2006 Nakanishi ..... B24B 21/002 451/6
7,066,792 B2 * 6/2006 Taylor ..... B24B 37/26 451/63
7,985,120 B2 * 7/2011 Osaki ..... G05B 19/19 451/910
8,038,508 B2 * 10/2011 Lim ..... B24B 49/12 451/6
8,041,446 B2 * 10/2011 Inoue ..... B24B 49/03 451/28
8,078,306 B2 * 12/2011 Nakao ..... B24B 37/013 700/121
8,554,356 B2 * 10/2013 Shimizu ..... B24B 49/12 451/6
8,641,480 B2 * 2/2014 Nakanishi ..... B24B 55/00 451/72
2002/0182985 A1 * 12/2002 Shiino ..... B24B 9/065 451/44
2003/0153251 A1 * 8/2003 Mizushima ..... B24B 9/065 257/E21.237
2006/0128281 A1 * 6/2006 Bando ..... C03B 33/10 451/70
2008/0070479 A1 * 3/2008 Nabeya ..... B24B 49/16 451/8
2008/0307829 A1 * 12/2008 Kawai ..... C03C 19/00
2009/0017733 A1 * 1/2009 Takahashi ..... H01L 21/67161 451/65
2009/0124174 A1 * 5/2009 Fukushima ..... B24B 9/065 451/310
2009/0142992 A1 * 6/2009 Takahashi ..... B24B 21/008 451/36
2011/0300777 A1 * 12/2011 Naya ..... B24B 27/0061 451/28
2014/0087627 A1 * 3/2014 Togawa ..... B24B 9/065 451/64
2015/0174724 A1 * 6/2015 Matsushita ..... B24B 9/105 451/178
2016/0167192 A1 * 6/2016 Otsuki ..... B24B 9/065 451/28

FOREIGN PATENT DOCUMENTS

JP H10-100050 A 4/1998
JP 2004-154880 A 6/2004

OTHER PUBLICATIONS

Written Opinion issued in Patent Application No. PCT/JP2015/080823 dated Dec. 15, 2015.
Chinese Office action issued in Patent Application No. CN-201580058353.X dated Aug. 20, 2018.

* cited by examiner

CHEMICAL MECHANICAL POLISHING APPARATUS FOR POLISHING WORKPIECE

CROSS-REFERENCE TO RELATED APPLICATIONS

This is a continuation of U.S. patent application Ser. No. 15/520,515, filed Apr. 20, 2017; which is the national stage of PCT/JP2015/080823, filed Oct. 30, 2015, which claims priority to Japanese Patent Application No. 2014-223292 filed Oct. 31, 2014, the entireties of which are incorporated herein by reference.

TECHNICAL FIELD

The present invention relates to a chemical mechanical polishing (CMP) apparatus for polishing a workpiece, such as a metal body, to a mirror finish.

BACKGROUND ART

From viewpoints of functionality and design, there has been a demand for mirror-polishing a workpiece having a three-dimensional surface constituted by a combination of a planar surface and a curved surface. Examples of such a workpiece include a metal body made of aluminum, stainless steel, or the like, and a resin body. Such metal body and resin body may be used in, for example, a cellular phone, a smart phone, a multifunction mobile terminal, a portable game device, a camera, a watch, a music media player, a personal computer, an electronic device, car parts, ornaments, medical equipment, or the like.

A conventional lapping technique and a conventional polishing technique can polish the planar surface to a mirror finish. However, it is very difficult for these techniques to polish the curved surface to a mirror finish.

SUMMARY OF INVENTION

Technical Problem

It is an object of the present invention to provide a chemical mechanical polishing apparatus capable of polishing a workpiece, having a periphery constituted by a curved surface, to a mirror finish.

Solution to Problem

In an aspect of the present invention, there is provided a chemical mechanical polishing apparatus for polishing a workpiece having a polygonal shape, comprising: a polishing pad having an annular polishing surface which has a curved vertical cross-section; a rotatable polishing table supporting the polishing pad; a workpiece holder for holding the workpiece; a rotating device configured to rotate the workpiece holder about an axis of the workpiece; a pressing device configured to press a periphery of the workpiece against the annular polishing surface; a polishing-liquid supply nozzle configured to supply a polishing liquid onto the annular polishing surface; and an operation controller configured to change a speed at which the rotating device rotates the workpiece according to a rotation angle of the workpiece, wherein the pressing device is disposed more inwardly than the workpiece holder in a radial direction of the polishing table.

In a preferred aspect, the chemical mechanical polishing apparatus further comprises a polished-state monitoring device configured to monitor a polished state of the periphery of the workpiece.

In a preferred aspect, the polishing pad has an annular shape, and the polishing pad has an inner peripheral surface which constitutes the annular polishing surface.

Advantageous Effects of Invention

According to the present invention, the periphery of the workpiece is polished by the sliding contact with the annular polishing surface. The annular polishing surface has a curved vertical cross-section. Therefore, a curved surface, constituting the periphery of the workpiece, uniformly contacts the annular polishing surface and is polished to a mirror finish.

DESCRIPTION OF EMBODIMENTS

Figure 1:
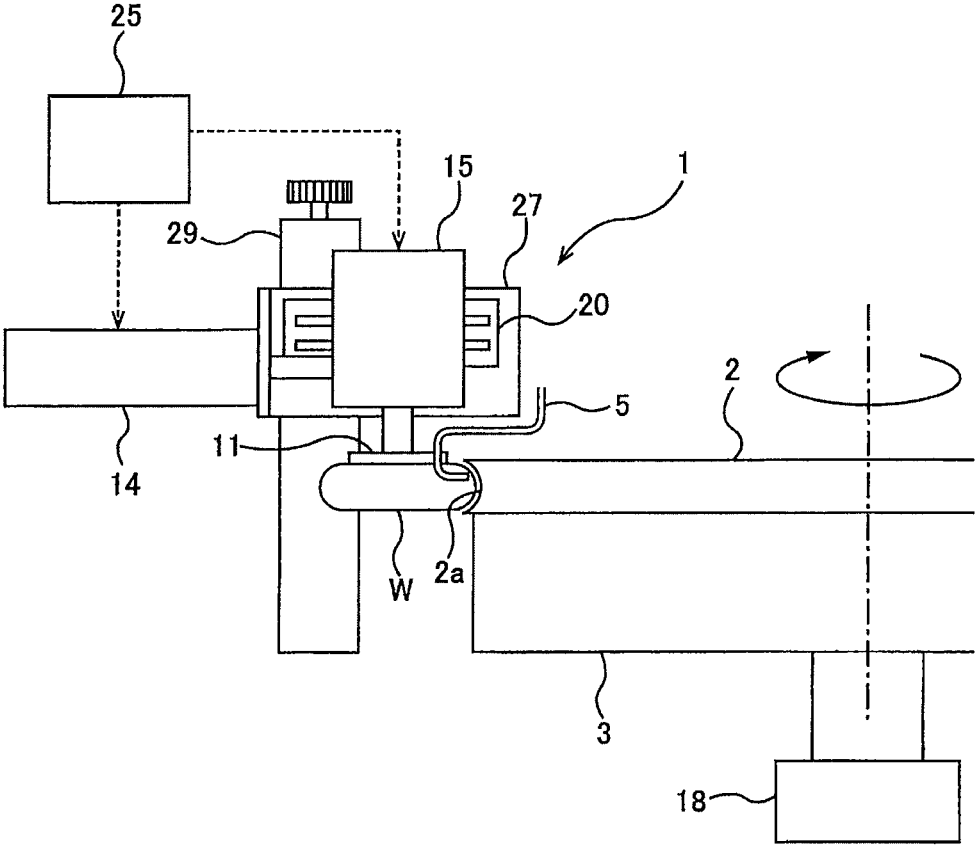
FIG. 1 is a side view of a chemical mechanical polishing apparatus according to an embodiment of the present invention.
Figure 2:
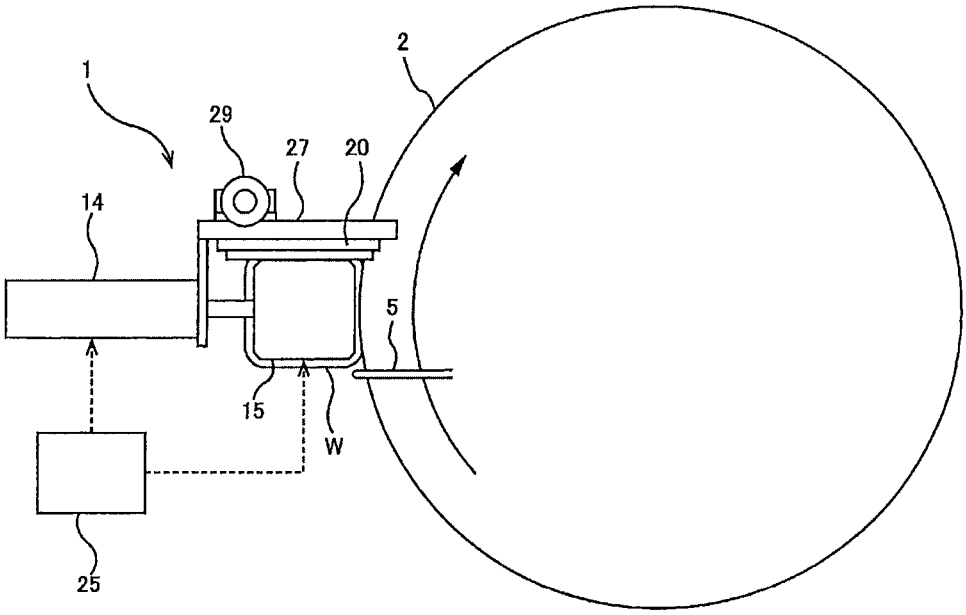
FIG. 2 is a plan view of the chemical mechanical polishing apparatus shown in FIG. 1.

Embodiments of the present invention will now be described with reference to the drawings. FIG. 1 is a side view of a chemical mechanical polishing apparatus according to an embodiment of the present invention, and FIG. 2 is a plan view of the chemical mechanical polishing apparatus. The chemical mechanical polishing apparatus includes a polishing pad 2 having an annular polishing surface 2*a*, a rotatable polishing table 3 supporting the polishing pad 2, a polishing-liquid supply nozzle 5 for supplying a polishing liquid onto the annular polishing surface 2*a*, and a polishing head 1 for pressing a periphery of a workpiece W against the annular polishing surface 2*a* of the polishing pad 2 to polish the periphery of the workpiece W.

The periphery of the workpiece W is composed of a curved surface. The annular polishing surface 2*a* has an inwardly-curved vertical cross-section that follows a shape of a vertical cross-section of the periphery of the workpiece W. The curvature of the curved vertical cross-section of the annular polishing surface 2*a* is equal to or slightly larger than the curvature of the vertical cross-section of the periphery of the workpiece W.

The polishing head 1 includes a workpiece holder 11 for holding the workpiece W, a servomotor 15 as a rotating device for rotating the workpiece holder 11 about an axis of the workpiece W, and an air cylinder 14 as a pressing device for pushing the servomotor 15 toward the center of the polishing pad 2 to thereby press the periphery of the workpiece W, held by the workpiece holder 11, against the annular polishing surface 2*a*.

The polishing pad 2 of this embodiment has a disk shape, and the annular polishing surface 2*a* constitutes at least a part of a circumferential surface of the polishing pad 2. The polishing pad 2 is attached to an upper surface of the polishing table 3. The polishing table 3 is configured to be rotated about its axis by a table motor 18, so that the polishing pad 2 rotates about its axis together with the polishing table 3.

The workpiece holder 11 is configured to be able to detachably hold the workpiece W by screwing, magnetic force, vacuum suction, freezing chuck, vacuum attraction chuck, or other technique. The workpiece holder 11 is configured to hold the workpiece W in a horizontal position.

The workpiece holder 11 is coupled to the servomotor 15. The servomotor 15 is a rotating device for rotating the workpiece holder 11 and the workpiece W, held by the workpiece holder 11, about their axis. The servomotor 15 has a built-in rotary encoder (not shown) for measuring a rotation angle of the workpiece holder 11 and the workpiece W.

The servomotor 15 is held by a horizontally-extending linear guide 20, and is horizontally movable along a longitudinal direction of the linear guide 20. The longitudinal direction of the linear guide 20 is parallel to a radial direction of the polishing pad 2. Therefore, the servomotor 15, the workpiece holder 11, and the workpiece W are movable in the radial direction of the polishing pad 2.

The servomotor 15 is coupled to the air cylinder 14. This air cylinder 14 is configured to move the servomotor 15, the workpiece holder 11, and the workpiece W together in a horizontal direction (i.e., in the radial direction of the polishing pad 2). More specifically, the air cylinder 14 is capable of moving the workpiece W in directions away from and closer to the annular polishing surface 2*a* of the polishing pad 2.

When the air cylinder 14 pushes the servomotor 15 toward the center of the polishing pad 2, the workpiece holder 11 and the workpiece W, together with the servomotor 15, move toward the annular polishing surface 2*a*, until the periphery of the workpiece W is pressed against the annular polishing surface 2*a*. The force with which the periphery of the workpiece W is pressed against the annular polishing surface 2*a* is regulated by the air cylinder 14.

An operation controller 25 is coupled to the air cylinder 14 and the servomotor 15. The operation controller 25 is configured to control operations of the air cylinder 14 and the servomotor 15. More specifically, the operation controller 25 controls the force generated by the air cylinder 14, i.e., the force with which the periphery of the workpiece W is pressed against the annular polishing surface 2*a*, and also controls the speed at which the servomotor rotates the workpiece W.

The linear guide 20 and the air cylinder 14 are secured to a base 27. The base 27 is coupled to a positioning mechanism 29 for adjusting a vertical position of the base 27. The vertical positions of the air cylinder 14, the linear guide 20, and the workpiece holder 11 are adjusted by the positioning mechanism 29. Accordingly, the vertical position of the workpiece W, held by the workpiece holder 11, relative to the annular polishing surface 2*a* is also adjusted by the positioning mechanism 29.

An outlet of the polishing-liquid supply nozzle 5 is directed to the annular polishing surface 2*a* of the polishing pad 2 so that a polishing liquid, such as a slurry, is supplied onto the annular polishing surface 2*a*. The outlet of the polishing-liquid supply nozzle 5 is disposed upstream of the workpiece W in a direction of rotation of the polishing pad 2 and the polishing table 3. Therefore, the polishing liquid, supplied from the polishing-liquid supply nozzle 5, is carried by the rotating annular polishing surface 2*a* to the periphery of the workpiece W, which is a portion to be polished.

The polishing operation of the chemical mechanical polishing apparatus will now be described. While the polishing pad 2 and the polishing table 3 are being rotated as shown in FIGS. 1 and 2, a polishing liquid (slurry) is supplied from the polishing-liquid supply nozzle onto the annular polishing surface 2*a* of the polishing pad 2. Further, the workpiece holder 11 and the workpiece W are rotated by the servomotor 15. The air cylinder 14 pushes the servomotor 15, the workpiece holder 11, and the workpiece W toward the center of the polishing pad 2, thereby pressing the periphery of the workpiece W against the annular polishing surface 2*a*. The periphery of the workpiece W is rubbed against the annular polishing surface 2*a* in the presence of the polishing liquid. The periphery of the workpiece W is polished to have a mirror surface by a chemical component of the polishing liquid and abrasive particles contained in the polishing liquid. Since the annular polishing surface 2*a* has a vertical cross-section that follows the shape of the vertical cross-section of the periphery of the workpiece W, the curved surface, constituting the periphery of the workpiece W, uniformly contacts the annular polishing surface 2*a* and is polished to a mirror finish.

Figure 3:
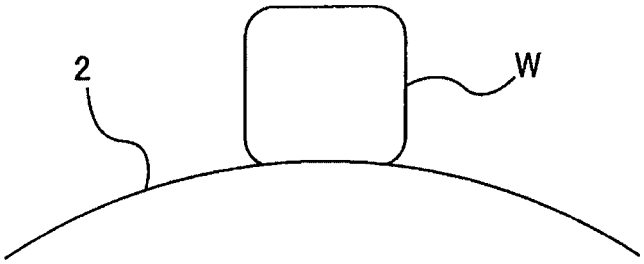
FIG. 3 is a diagram showing a rectangular workpiece at a rotation angle of 0 degrees.
Figure 4:
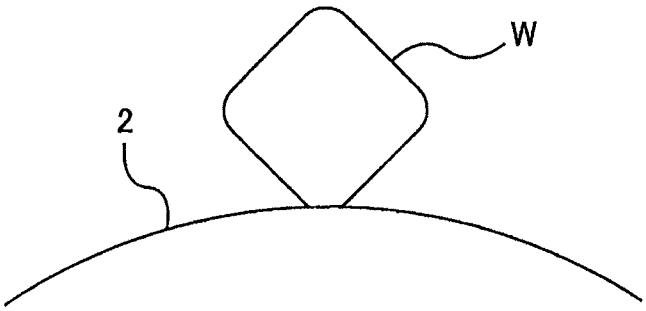
FIG. 4 is a diagram showing the rectangular workpiece at a rotation angle of 45 degrees.
Figure 5:
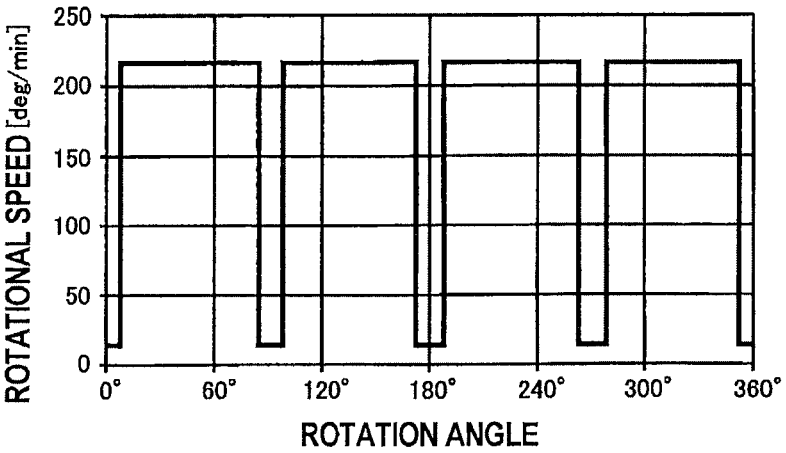
FIG. 5 is a graph showing a relationship between rotation angle of a workpiece and rotational speed of the workpiece.

When the workpiece W has a rectangular shape, it is preferred that an entire periphery of the workpiece W be polished uniformly. In view of this, the operation controller 25 is configured to change the rotational speed of the workpiece W according to the rotation angle of the workpiece W. FIG. 3 is a diagram showing the rectangular workpiece W at a rotation angle of 0 degrees, and FIG. 4 is a diagram showing the rectangular workpiece W at a rotation angle of 45 degrees. FIG. 5 is a graph showing a relationship between the rotation angle of the workpiece W and the rotational speed of the workpiece W. A vertical axis of FIG. 5 represents the rotational speed [angular degrees/min] of the workpiece W, and a horizontal axis represents the rotation angle of the workpiece W. The workpiece W is in the state shown in FIG. 3 when the rotation angle of the workpiece W is 0 degrees: a linear portion of the periphery of the workpiece W is in contact with the polishing pad 2. As shown in FIG. 5, the rotational speed of the workpiece W is lowered each time the workpiece W rotates 90 degrees, i.e., with a period of 90 degrees.

The rotation angle of the workpiece W is obtained by the above-described rotary encoder installed in the servomotor 15. A measured value of the rotation angle is sent from the rotary encoder to the operation controller 25. The operation controller 25 changes the rotational speed of the workpiece W based on the measured value of the rotation angle.

According to the embodiment shown in FIG. 5, a time of contact between the workpiece W and the annular polishing surface 2*a* can be uniform over the entire periphery of the workpiece W. The polishing pad 2 can therefore uniformly polish the periphery of the workpiece W.

Figure 6:
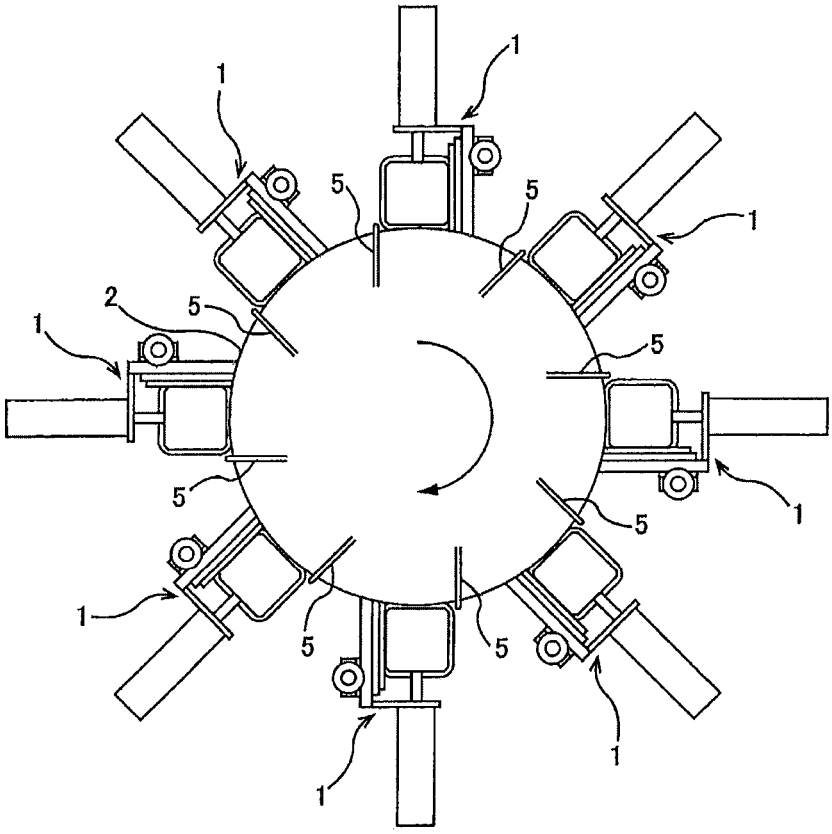
FIG. 6 is a plan view of a chemical mechanical polishing apparatus including a plurality of polishing heads.

FIG. 6 is a plan view of a chemical mechanical polishing apparatus including a plurality of polishing heads 1. As shown in FIG. 6, a plurality of polishing heads 1 may be arranged along a circumferential direction of the polishing pad 2. A plurality of polishing-liquid supply nozzles 5 are disposed adjacent to the polishing heads 1, respectively.

The chemical mechanical polishing apparatus may include a polished-state monitoring device for monitoring a polished state of the periphery of the workpiece W. In the embodiment shown in FIG. 7, the chemical mechanical polishing apparatus includes a surface-condition monitoring device 32 as the polished-state monitoring device, which monitors a surface condition of the periphery of the workpiece W held by the workpiece holder 11. Examples of such a surface-condition monitoring device 32 may include a camera (e.g., a digital camera equipped with an image sensor such as CCD) for imaging the periphery of the workpiece W, and a photometer for measuring an intensity of light reflected from the periphery of the workpiece W.

The surface-condition monitoring device 32 quantifies the surface condition of the periphery of the workpiece W, and sends a numerical value obtained to the operation controller 25. For example, the surface-condition monitoring device 32 may obtain a numerical value of a color or irregularities of the peripheral surface of the workpiece W, or may obtain a numerical value of the intensity of light reflected from the peripheral surface. In order to make it easy to detect a change in the color, paint may be applied to the peripheral surface of the workpiece W in advance. The operation controller 25 determines a polishing end point of the workpiece W based on the numerical value (i.e., the surface condition of the periphery of the workpiece W) sent from the surface-condition monitoring device 32.

Figure 8:
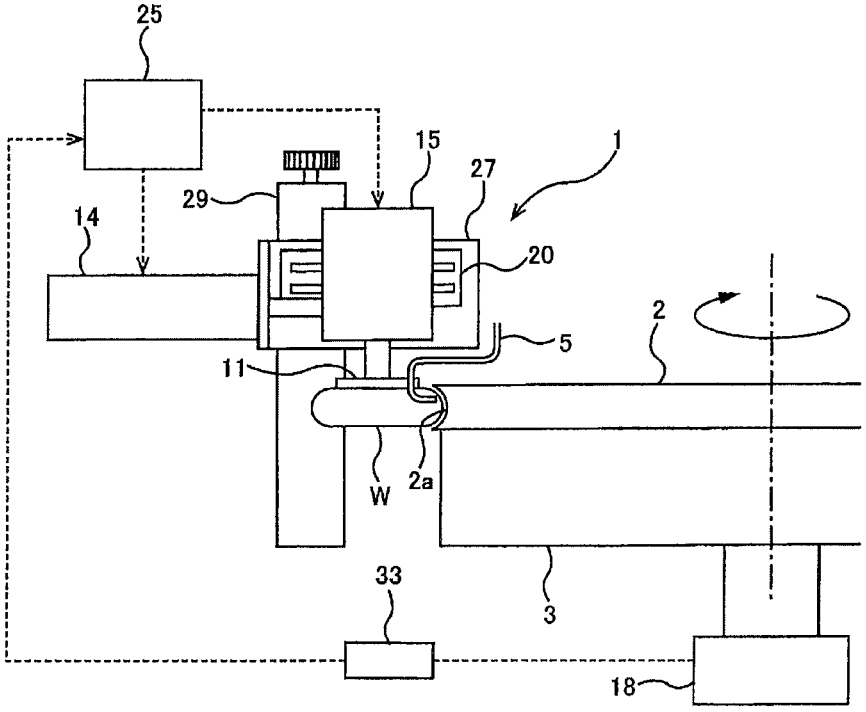
FIG. 8 is a side view of a chemical mechanical polishing apparatus including a motor ammeter for monitoring an electric current supplied to a table motor for rotating a polishing table.

In the embodiment shown in FIG. 8, the chemical mechanical polishing apparatus includes a motor ammeter 33 as the polished-state monitoring device, which monitors an electric current supplied to the table motor 18 that rotates the polishing table 3. A frictional force that acts between the workpiece W and the polishing pad 2 changes as the peripheral surface of the workpiece W becomes smoother as a result of polishing. The change in the frictional force leads to a change in the electric current supplied to the table motor 18. The motor ammeter 33 measures the electric current that flows to the table motor 18, and sends a measured value of the electric current to the operation controller 25. The operation controller 25 determines a polishing end point of the workpiece W based on the measured value of the electric current (i.e., the surface condition of the periphery of the workpiece W) sent from the motor ammeter 33.

Figure 9:
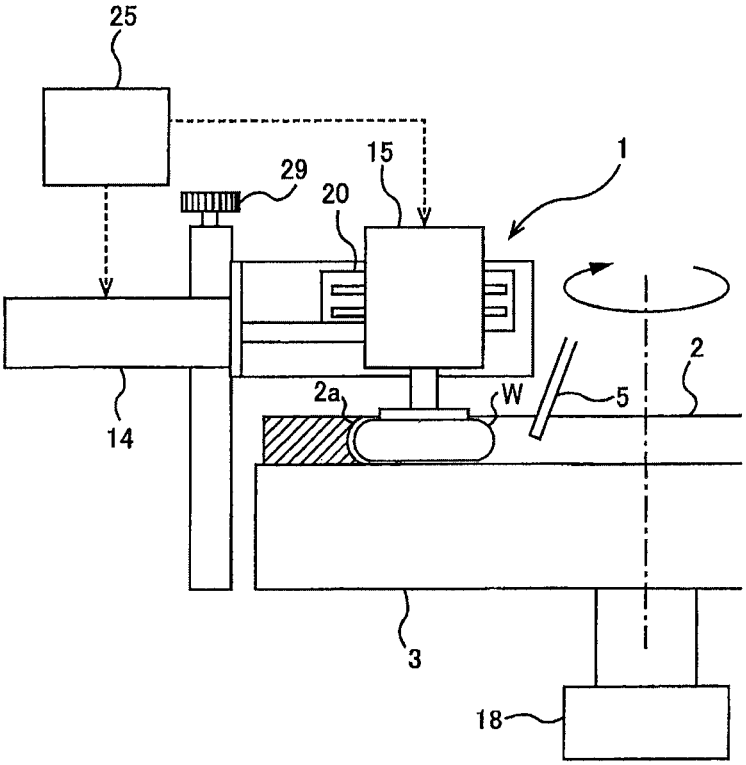
FIG. 9 is a side view of a chemical mechanical polishing apparatus according to another embodiment.
Figure 10:
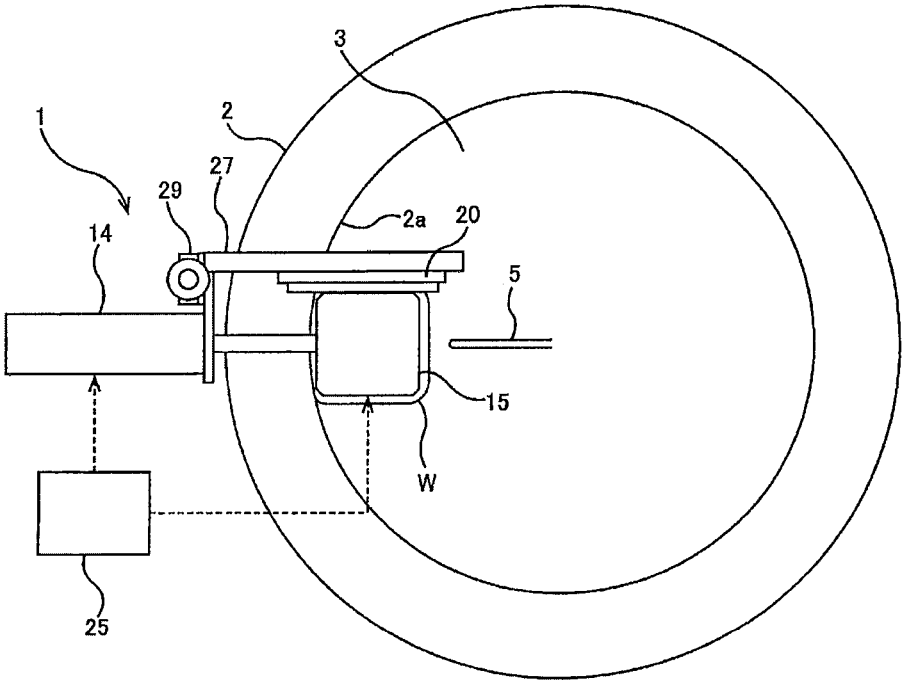
FIG. 10 is a plan view of the chemical mechanical polishing apparatus shown in FIG. 9.

FIG. 9 is a side view of a chemical mechanical polishing apparatus according to yet another embodiment, and FIG. 10 is a plan view of the chemical mechanical polishing apparatus shown in FIG. 9. An annular polishing pad 2 is used in this embodiment. An inner peripheral surface of the annular polishing pad 2 constitutes an annular polishing surface 2*a*. The annular polishing surface 2*a* has an outwardly curved vertical cross-section. The polishing liquid is supplied onto an area located inside the annular polishing surface 2*a*, and flows outwardly due to a centrifugal force until the polishing liquid reaches the annular polishing surface 2*a*. The annular polishing pad 2 can easily hold the polishing liquid on its annular polishing surface 2*a*, and can therefore reduce an amount of the polishing liquid used.

Figure 11:
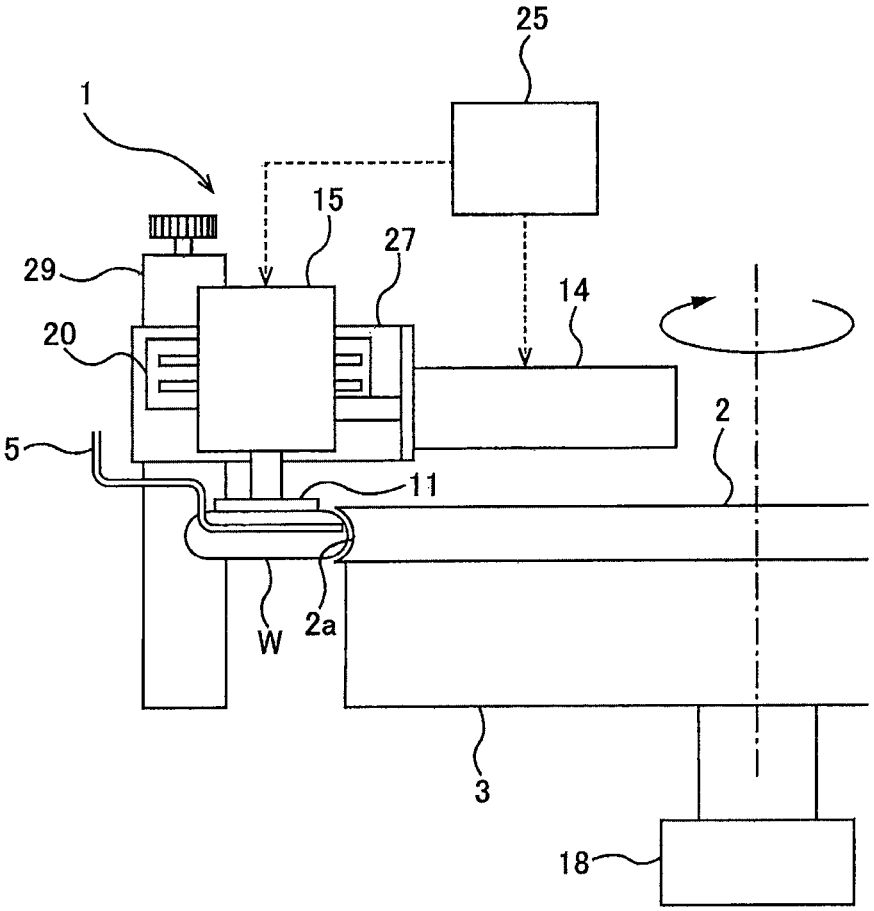
FIG. 11 is a side view of a chemical mechanical polishing apparatus according to yet another embodiment.
Figure 12:
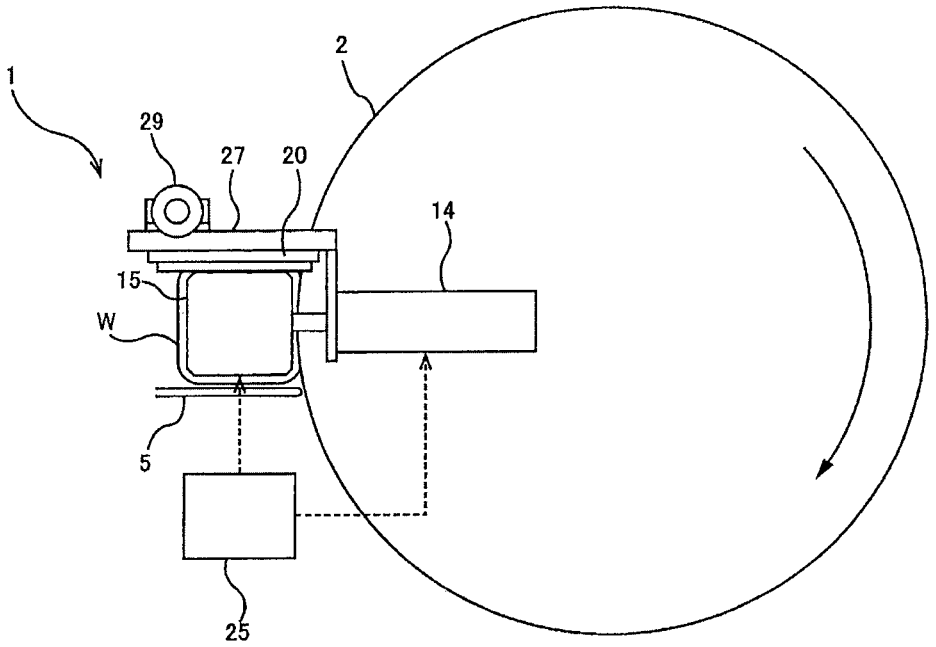
FIG. 12 is a plan view of the chemical mechanical polishing apparatus shown in FIG. 11.

FIG. 11 is a side view of a chemical mechanical polishing apparatus according to yet another embodiment, and FIG. 12 is a plan view of the chemical mechanical polishing apparatus shown in FIG. 11. The construction and the operation of this embodiment, not particularly described here, are the same as those of the embodiment shown in FIGS. 1 and 2, and duplicate descriptions thereof are omitted. In this embodiment, the air cylinder 14 is disposed more inwardly than the workpiece holder 11 (preferably along the radially inner side of the workpiece holder 11) in the radial direction of the polishing table 3 (and the polishing pad 2). In FIG. 11, the air cylinder 14 is located above the polishing table 3 and the polishing pad 2. The air cylinder 14 may be located below the polishing table 3 and the polishing pad 2. The air cylinder 14 moves the servomotor 15, the workpiece holder 11, and the workpiece W toward the center of the polishing pad 2, thereby pressing the periphery of the workpiece W against the annular polishing surface 2*a*.

Figure 13:
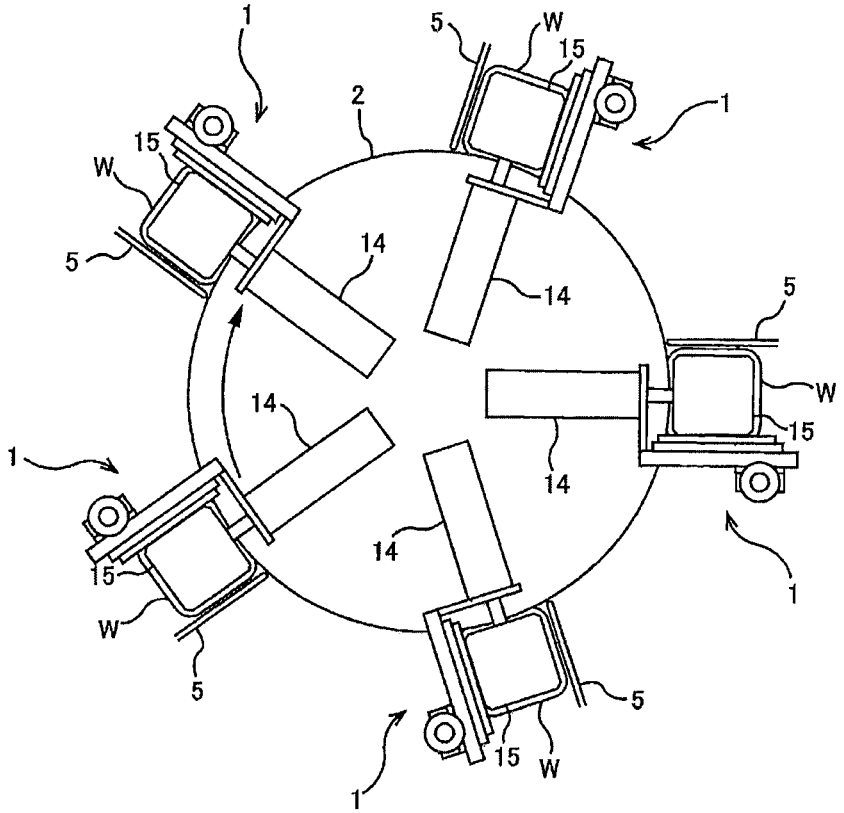
FIG. 13 is a plan view of an embodiment of a chemical mechanical polishing apparatus including a plurality of polishing heads shown in FIGS. 11 and 12.

FIG. 13 is a plan view of an embodiment of a chemical mechanical polishing apparatus including a plurality of polishing heads 1, each of which is shown in FIGS. 11 and 12. The air cylinders 14 of the polishing heads 1 are located inside the polishing table 3 and the polishing pad 2. Therefore, as can be seen in FIG. 13, the overall width of the chemical mechanical polishing apparatus can be small.

Figure 7:
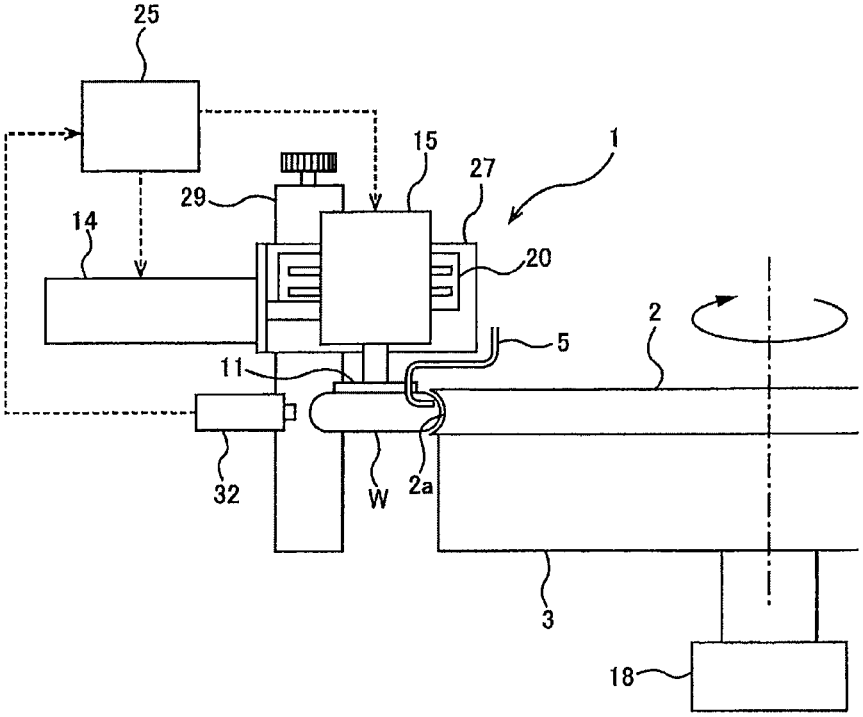
FIG. 7 is a side view of a chemical mechanical polishing apparatus including a surface-condition monitoring device for monitoring a surface condition of a periphery of a workpiece.

The surface-condition monitoring device 32 shown in FIG. 7, and the motor ammeter 33 as another exemplary surface-condition monitoring device, shown in FIG. 8, can be applied also to the embodiments shown in FIGS. 11 through 13. Further, the annular polishing pad 2 shown in FIGS. 9 and 10 may be applied to the embodiments shown in FIGS. 11 through 13.

In the above-described embodiments, the workpiece W, in its entirety, has a rectangular shape, and its periphery has an outwardly curved vertical cross-section. The chemical mechanical polishing apparatuses according to the above-described embodiments can be used not only for polishing of a workpiece having, in its entirety, a polygonal shape, but also for polishing of a workpiece having, in its entirety, a circular shape.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a chemical mechanical polishing (CMP) apparatus for polishing a workpiece, such as a metal body, to a mirror finish.

REFERENCE SIGNS LIST

1 polishing head
2 polishing pad
2*a* annular polishing surface
3 polishing table

5 polishing-liquid supply nozzle
11 workpiece holder
14 air cylinder
15 servomotor
18 table motor
20 linear guide
25 operation controller
27 base
29 positioning mechanism
32 surface-condition monitoring device
33 motor ammeter
W workpiece

The invention claimed is:

1. A polishing method comprising:

rotating a workpiece having a rectangular shape, the workpiece having a linear portion and a corner portion constituting a periphery of the workpiece;

polishing the workpiece by pressing the workpiece with a pressing device against a side surface of a polishing pad, the pressing device being disposed above the polishing pad; and lowering a rotational speed of the workpiece with a period of 90 degrees such that the rotational speed when the corner portion is being polished is lower than the rotational speed when the linear portion is being polished during polishing of the workpiece.

2. The polishing method according to claim 1, further comprising:

measuring the rotational angle of the workpiece by a rotary encoder.

3. The polishing method according to claim 1, wherein:

rotating the workpiece comprises rotating a plurality of workpieces each having a rectangular shape, each workpiece having a linear portion and a corner portion constituting a periphery of each workpiece;

polishing the workpiece comprises polishing the workpieces by pressing the workpieces with a plurality of pressing devices against the side surface of the polishing pad at the same time, the plurality of pressing devices being disposed above the polishing pad; and lowering the rotational speed comprises lowering rotational speeds of the workpieces with a period of 90 degrees such that the rotational speeds when the corner portions are being polished are lower than the rotational speeds when the linear portions are being polished during polishing of the workpieces.

4. The polishing method according to claim 1, further comprising:

rotating the polishing pad; and during polishing of the workpiece, supplying a polishing liquid from a polishing-liquid supply nozzle onto the side surface of the polishing pad, the polishing-liquid supply nozzle being disposed upstream of the workpiece in a direction of the rotation of the polishing pad.

5. The polishing method according to claim 1, further comprising:

monitoring a polished state of a periphery of the workpiece by a polished-state monitoring device during polishing of the workpiece; and determining a polishing end point of the workpiece based on the polished state monitored by the polished-state monitoring device.

6. The polishing method according to claim 5, wherein the polished-state monitoring device comprises a digital camera having an image sensor or a photometer configured to measure an intensity of light reflected from the workpiece.

7. The polishing method according to claim 5, wherein:

the workpiece comprises a painted workpiece; and determining the polishing end point comprises determining the polishing end point of the workpiece based on a change in a color of the painted workpiece monitored by the polished-state monitoring device.

8. The polishing method according to claim 1, further comprising:

measuring an electric current supplied to a table motor configured to rotate a rotatable polishing table supporting the polishing pad; and determining a polishing end point of the workpiece based on a measured value of the electric current.

* * * * *